US009234353B2

(12) United States Patent
Pavlansky et al.

(10) Patent No.: US 9,234,353 B2
(45) Date of Patent: Jan. 12, 2016

(54) POROUS COVER MAT ESPECIALLY SUITED FOR USE WITH K-STYLE GUTTERS

(71) Applicants: Mark Pavlansky, Elkin, NC (US); Keith Pavlansky, Yadkinville, NC (US)

(72) Inventors: Mark Pavlansky, Elkin, NC (US); Keith Pavlansky, Yadkinville, NC (US)

( * ) Notice: Subject to any disclaimer, the term of this patent is extended or adjusted under 35 U.S.C. 154(b) by 0 days.

(21) Appl. No.: 13/766,934

(22) Filed: Feb. 14, 2013

(65) Prior Publication Data

US 2014/0223837 A1 Aug. 14, 2014

(51) Int. Cl.
*E04D 13/076* (2006.01)

(52) U.S. Cl.
CPC ..... *E04D 13/076* (2013.01); *E04D 13/0765* (2013.01); *E04D 13/0767* (2013.01)

(58) Field of Classification Search
CPC ..... E04D 13/076; E04D 13/0765; E04D 13/0767; E04D 2013/086; E04D 2013/0866
USPC ..... 52/12, 11, 13; 210/170.03, 483, 162, 210/499, 505–506, 508, 473, 474, 496, 210/504; 442/58, 103, 131
See application file for complete search history.

(56) References Cited

U.S. PATENT DOCUMENTS

| | | | | | |
|---|---|---|---|---|---|
| 2,297,248 | A * | 9/1942 | Rudolph | 521/145 |
| 2,772,195 | A * | 11/1956 | Gaarder | 156/184 |
| 3,855,132 | A * | 12/1974 | Dugan | 210/455 |
| 4,841,686 | A * | 6/1989 | Rees | 52/12 |
| 4,949,514 | A * | 8/1990 | Weller | 52/12 |
| 5,006,399 | A * | 4/1991 | Salminen et al. | 442/189 |
| 5,167,579 | A * | 12/1992 | Rotter | 454/365 |
| 5,592,783 | A * | 1/1997 | Jones | 52/12 |
| 5,595,027 | A * | 1/1997 | Vail | 52/12 |
| 5,972,463 | A * | 10/1999 | Martin et al. | 428/95 |
| 6,134,843 | A * | 10/2000 | Tregear | 52/12 |
| 6,932,911 | B1 * | 8/2005 | Groth et al. | 52/12 |
| 7,051,480 | B1 * | 5/2006 | Dennis | 52/24 |
| 7,208,081 | B2 * | 4/2007 | Jones | 210/162 |
| 7,303,687 | B2 * | 12/2007 | Groth et al. | 52/12 |
| 7,585,454 | B2 * | 9/2009 | Noga et al. | 264/555 |
| 8,099,909 | B2 * | 1/2012 | Bottriell | 52/12 |
| 2002/0046970 | A1 * | 4/2002 | Murase et al. | 210/483 |
| 2004/0089602 | A1 * | 5/2004 | Heinrich et al. | 210/505 |
| 2005/0009428 | A1 * | 1/2005 | Porter et al. | 442/129 |
| 2005/0178072 | A1 * | 8/2005 | Olthoff | 52/12 |
| 2005/0247611 | A1 * | 11/2005 | Groth et al. | 210/162 |
| 2005/0266230 | A1 * | 12/2005 | Hill et al. | 428/317.9 |
| 2006/0037253 | A1 * | 2/2006 | Mozeika | 52/12 |
| 2006/0096910 | A1 * | 5/2006 | Brownstein et al. | 210/490 |
| 2007/0175106 | A1 * | 8/2007 | Rotter | 52/12 |
| 2008/0029210 | A1 * | 2/2008 | Swei et al. | 156/272.2 |
| 2008/0283465 | A1 * | 11/2008 | Liu et al. | 210/496 |
| 2009/0249704 | A1 * | 10/2009 | Wilson et al. | 52/12 |
| 2012/0047818 | A1 * | 3/2012 | Lopez | 52/12 |
| 2012/0247031 | A1 * | 10/2012 | Konkey | 52/12 |
| 2013/0145699 | A1 * | 6/2013 | Olthoff | 52/12 |
| 2013/0146529 | A1 * | 6/2013 | Schwender et al. | 210/490 |

* cited by examiner

*Primary Examiner* — Robert Canfield
*Assistant Examiner* — Babajide Demuren

(57) ABSTRACT

A cover mat suitable for use in preventing debris from entering a rain gutter does not require support when positioned in the gutter other than by portions of the rain gutter engaging the cover mat. The cover mat is formed of a nonwoven polyester fiber material that is coated with a stiffening agent, such as a styrene monomer that will add stiffness without significantly affecting the flow of fluids through the porous or liquid permeable fiber mat.

20 Claims, 4 Drawing Sheets

POROUS COVER MAT ESPECIALLY SUITED FOR USE WITH K-STYLE GUTTERS

BACKGROUND OF THE INVENTION

1. Field of the Invention

This invention is related to standard gutters, such as standard K-style gutters, and a porous or liquid permeable covering device which fits into the top portion of the gutter to prevent debris, such as leaves or twigs from entering the gutter to prevent the gutter from being clogged.

2. Description of the Prior Art

There are a number of devices that are employed to prevent solid debris, such as leaves, pine needles, twigs and litter from entering a rain gutter and clogging the gutter. There are a number of shields or filters that are employed to prevent entry of solid debris, but allow water to pass over the filter or shield and enter the gutter. Alternatively some prior art techniques employ a porous filler or filter material that can be inserted into and at least partially fill the gutter. The porous filler material will be liquid permeable so that rain water can flow through the material and in the rain gutter. The pores or openings in such materials are, however, sufficient small to prevent the entry of solid debris that is not dissolved in the rain water or in liquid flowing into the gutter. The solid debris will then accumulate on top of the filler material where it will normally be removed by the wind or by gravity.

U.S. Pat. No. 8,341,891 discloses a device for preventing clogging of a rain gutter by leaves, twigs and other solid debris. This device includes a liquid permeable foam strip which sets on top of a thermoformed support member including a series of arms adhered to the lower surface of the foam member, but leaving much of the foam member unobstructed so that rain can flow through the foam strip and into the rain gutter. The thermoformed support member has a series of legs extending downwardly therefrom to engage the bottom of the a rain gutter, such as a standard K-style gutter, to elevate the foam strip relative to the bottom of the rain gutter. Preferably the foam member is formed from a reticulated foam and the foam member has a thickness so that it will fit in an inwardly facing slot on a K-style gutter.

U.S. Pat. No. 3,855,132 discloses the use of a porous polyurethane foam to fill a rain gutter. Rain water will flow through a sufficiently porous foam filling the rain gutter, but debris, such as leaves and paper scraps remain on the upper surface of the foam filler and cannot enter the rain gutter where clogs typically form. Supports can be provided along the length of the foam filler to leave an open passageway beneath the foam filler and above the bottom of the rain gutter.

US Patent Application Publication 2005/0034376 discloses the use of a porous sponge-like filler materials, such as fibers or foam or non-woven materials that can be cut to shape and packed into the gutter.

US Patent Application Publication 2005/0247611 discloses the use of a thick mat formed from a nonwoven material including randomly oriented and interconnected fibers or filaments forming open interstices affixed by a binder or coating. This mat is inserted into a rain gutter and in some cases in conjunction with a filter will prevent twigs, pine needles etc. from entering the rain gutter. Openings may be formed between the porous mat and bottom or side surfaces of the gutter to permit flow beneath the mat insert. U.S. Pat. No. 7,208,081 and US Published Patent Application 2006/0037253 show similar gutter filler in which the foam filter material partially fills the gutter.

US Published Patent Application 2001/0037610 discloses a composite gutter guard with a PVC coated fiberglass mesh layer bonded to a polymeric panel having a plurality of filter openings. U.S. Pat. No. 5,595,027 similarly shows a tangled mesh fiberglass bonded to a vinyl sheet that fits over a gutter with the mesh extending below openings in the vinyl sheet.

Even though these gutter filler products are porous, some can restrict the flow in a gutter, and because they must fill a substantial volume of the gutter, they can be relatively bulky and will use a significant amount of a material. In some of these devices an air permeable material must be bonded to a separate support that is in turn mounted in the gutter. It may also be difficult to install these products on rain gutters because roofing shingles may partially obstruct the rain gutters and gutter hangers can present obstructions.

SUMMARY OF THE INVENTION

A gutter cover according to this invention can be mounted on a rain gutter. The gutter cover comprises a porous fiber mat comprising randomly disposed fibers held together by a binding agent. A coating separate from the binding agent, and overlying at least a portion of the fibers, includes a stiffening agent adding rigidity to the porous fiber mat so that the porous fiber mat can be disposed along the top of the rain gutter, without a supporting structure joined to the porous fiber mat. The porous fiber mat is sufficiently porous to allow passage of rainwater therethrough into the rain gutter, but preventing passage of solid debris into the rain gutter.

According to another aspect of this invention the rain gutter cover comprises a fiber mat further comprising a plurality of randomly oriented fibers. A first material is applied to the fibers and has sufficient tackiness to adhere to the fibers and to bind the fibers together when dried to form the fiber mat so that the fiber mat is sufficiently porous to allow passage of rain water therethrough into the rain gutter when mounted on the rain gutter. A second material is disposed at least partially over the randomly oriented fibers, the second material, when dried, imparting a greater bending resistance to the fiber mat than the first material. The gutter cover can be disposed on the rain gutter without support other than by portions of the rain gutter to which the fiber mat engages.

This rain gutter cover can be used in an assembly including a standard rain gutter, such as a K-style rain gutter. This rain gutter cover has a front edge insertable into the slot on the rain gutter and lying on the hangers, the gutter cover further comprises a fiber mat comprising randomly disposed fibers held together by a binding agent. A coating separate from first binding agent, includes a stiffening agent adding rigidity to the porous fiber mat so that the porous fiber mat remains elevated in the rain gutter without the use of supporting members attached to the porous fiber mat.

DETAILED DESCRIPTION OF THE PREFERRED EMBODIMENT

Figures 1, 2:
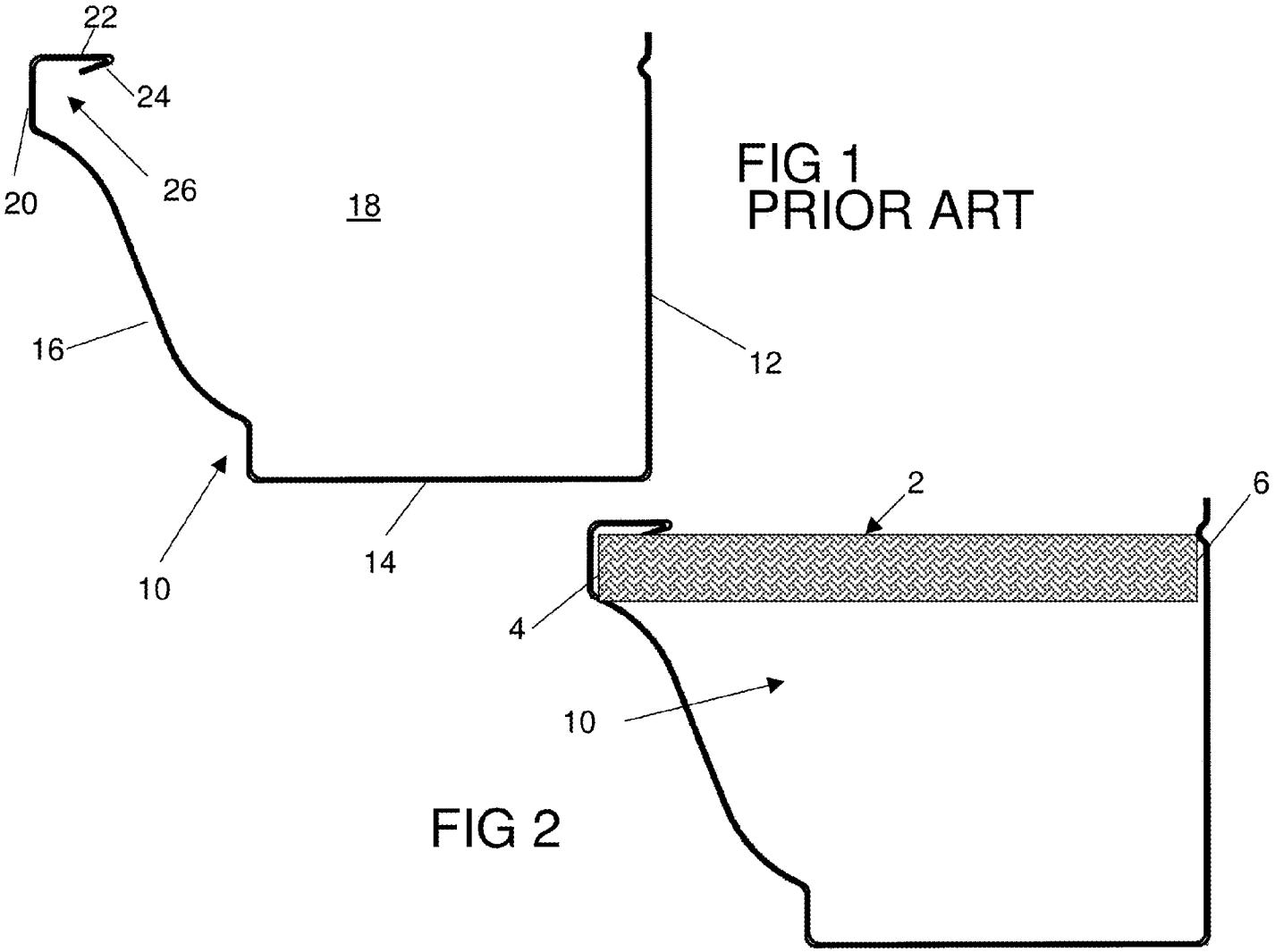
FIG 1 PRIOR ART
FIG. 1 is a view of the profile of a standard prior art K-style roll gutter with which the cover of this invention is to be used.
FIG. 2 shows the porous or liquid permeable gutter cover of this invention positioned within the K-style gutter shown in FIG. 1.
Figure 3:
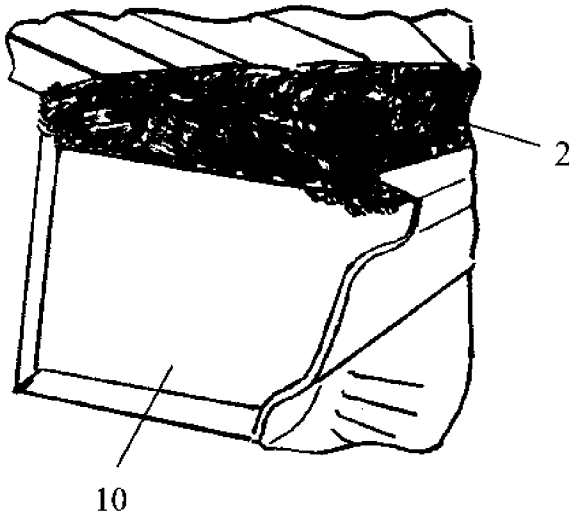
FIG. 3 shows the porous or liquid permeable gutter cover installed near an end of a K-style gutter.
Figure 4:
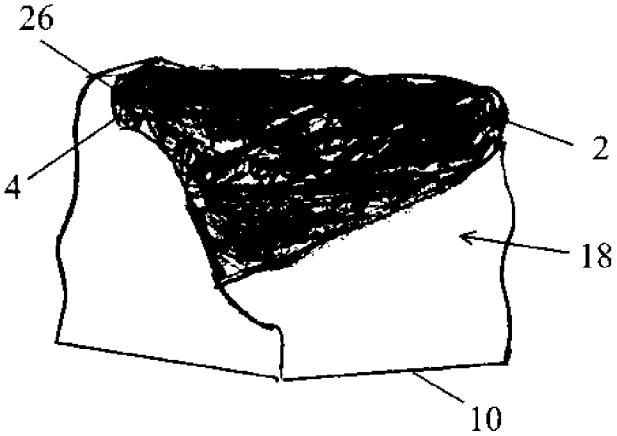
FIG. 4 is a view showing the porous or liquid permeable gutter cover with one edge inserted into an interior slot of a K-style gutter showing how the cover is supported by the interference fit of this one edge in the gutter gap.

K-style gutters or K-gutters 10 are the most common form of residential gutter. These gutters 10 are generally seamless gutters that are roll formed from an aluminum sheet. The profile of a standard K-style gutter is shown in FIG. 1. The rear gutter wall 12 and the bottom gutter wall 14 extend generally perpendicular to each other. The outer wall 16 is curved and has an upright flat portion 20 inwardly extending lip 22 with a tab 24 bent inwardly into a slot 26 formed by the lip 22 and a curved portion of the outer gutter wall 16. One common size for K-style gutters used in residential applications is a five inch gutter in which the dimension between the rear wall 12 and the flat upright portion 20 of the outer wall parallel with the rear wall 12 and defining the rear of the slot 26, is five inches. The gutter walls from a channel 18. For a standard five inch K-style gutter, the height of the slot 26 is 0.6 inch. For larger buildings, such as commercial structure, a six inch K-style gutter is commonly used.

When a K-style gutter 10 of this type is mounted at the edge of a roof, a series of hangers generally extend from the rear wall to the upright portion of the outer wall. These hangers generally extend into the slot, and the tab on the gutter lip can engage the hanger. One simple form of gutter hanger is the spike in which a long spike in the form of a nail or screw is driven into the upright portion of the gutter and will extend across the gutter through the rear wall into the building wall beneath the roof. A ferrule fits over the spike so that the outer wall is not bent during installation. The tap on the gutter lip will engage the ferrule. Other types of gutter hangers include a reverse hook which engages the tab and generally have a flat profile. A hidden gutter hanger has an offset rear section through which a screw extends at an angle relative to the rear gutter wall and the building wall. These hidden gutters are invisible from the exterior.

The gutter cover 2 according to this invention is a porous or liquid permeable sheet or mat of material that is stiff enough so that it need not be separately supported relative to the gutter 10, and it does not need to rely upon the gutter hangers to support this gutter cover member 2. The stiffness needed to eliminate supporting structure needed for prior art covers is achieved by applying a stiffening agent to the polyester fiber mat forming the porous cover of this invention. The cover sheet 2 has a thickness that will allow it to be inserted into the gutter slot 26 as shown in FIG. 2, even if the cover mat 2 must be compressed to fit into the gutter slot 26. The cover sheet or mat 2 is stiff enough to remain in place, covering the top of the gutter 10 to prevent debris in the form of leaves and twigs from entering the gutter, but at the same time can be compressed to fit between the gutter hangers and the gutter lip or other portions of the standard gutter. The representative embodiment of the porous cover sheet 2 described herein is suited for use with a five inch K-style gutter. The same principles are employed for a porous cover sheet or mat used for a six inch K-style gutter or for other sizes.

The porous cover mat 2 of this invention does not require separate supports, and the spacing of gutter hangers is not critical. The spacing between the hangars makes no difference to the cover of this invention because this cover 2 is stiff enough that even if no hangar were present across a forty eight (48) length of the preferred cover mats, the cover would fit in the gutter and would perform as well as if there were multiple hangers spaced at two (2) or three (3) apart or any distance apart. The hangers may prevent some sagging, but don't add or detract from the performance of our product.

One edge 4 of the gutter cover according to this invention is inserted into the slot 26 on the inside of a K-style along substantially the entire length of the gutter cover or gutter cover sheet. In the preferred embodiment of this invention depicted herein, the thickness of the gutter cover is 0.75 inch. Other versions of this gutter cover can be 0.5 inch or 0.38 inch. However, the thicker the cover member 2, the greater its stiffness. FIG. 2 shows how the outside edge of the gutter cover 2 is inserted into the slot 26 formed on the outer side 16 of K-style gutter 10. Note that the inwardly formed tab 24 can dig into the gutter cover to provide stability.

The cover 2, according to this invention will conveniently fit over top of the hangars that are typically used. One commonly used hanger is a mechanically fastened hangar that clips in place on the front of the gutter, then is nailed or screwed to the opposite side into wood by the roof. Round and flat hangars are probably optimal, but our product doesn't need to be cut if the owner doesn't want to cut the material. Even if it is necessary to cut the cover mat to fit over a hanger, such as a hidden hanger that has an offset rear section through which an angled screw extends, it will still be relatively easy to cut an H-pattern in the gutter cover and fit it around the hidden hanger offset portion, because the cover according to this invention is relatively thin and does not employ separate supports that might interfered with the hanger. The material will fit readily over standard hangars, and still not be visible from the ground level. The outer edge 4 of the gutter cover 2 can also be compressed or deformed to either squeeze between the hanger and the gutter lip or it can be pinched inwardly around a hanger or cylindrical hanger ferrule, which may have a height substantially equal to the height of the slot 26. The gutter cover 2 and the fiber mat from which it is formed is compressible when inserted into the slot 26 and are resilient so that it exhibits recovery from compression.

The gutter cover according to the preferred embodiment of this invention is formed of a nonwoven polyester fibers mat fabricated in an airlaid process. In the preferred embodiment, the polyester fibers comprise recycled PET fibers. The polyester fibers are held together by a binder system comprising a cross linkable water based latex. A PVC coating is applied to resist oxidation and UV degradation, and to withstand wet/dry cycles. A flame retardant comprising a combination of hydrated aluminum and a phosphorous salt compound is also employed. A styrene is added to increase the stiffness of the mat so that separate supports are not required. In the preferred embodiment, a styrene monomer is employed. Although the styrene monomer increases the stiffness of the polyester fiber mat, the mat is still compressible and does not comprise a rigid structure that would resist deformation as the gutter cover is mounted on the K-style gutter and is squeezed into the slot 26 along the top outer edge of the gutter.

To fabricate the gutter cover 2, a fiber mat is first laid down. The material is a non-woven because there is not specific pattern being used to put the individual fibers together to form a fabric. The fibers are extruded and as they are extruded, there are a substantial quantity of them that are extruded across the head of the extruder. The multiple fibers then are randomly "interwoven" as the strands begin to form a mat and are carried down the production line. The mat is produced in master rolls of 0.75"×53"×120', The random nature of the strands of fiber are controlled to a limited extent by rollers that will help shape the mat to a specific thickness, and also a relative density. Subsequently the binding mixture of latex is sprayed onto the top and also the bottom of the fiber mat. The sprayed matting is then processed through an oven where the latex mixture is cured onto the fibers. This binding mixture holds the random fibers together. Following the oven cure process, the roll of mat fiber is run through a bath or a dip process of the next mixture of chemicals which in our application include the fire retardant, the styrene monomer, and color as well as the PVC material. As the mat exits the bath mixture, it is run through a set of nip rollers, and is then dried. The mat of fibers is finished after a curing of the coatings takes place, and so while the fibers of the mat are "interwoven" with each other, they are not woven into any specific pattern like a woven fabric would be.

The fiber mat without a styrene coating would be quite flexible, and significantly less stiff. It would have a lower compressive strength, and should also have less recovery. For a fiber mat according to this invention including a stiffening agent in the form of a styrene monomer, compression test results are as follows:

Test Method: TM.008 Compression Recovery Test
Average of 4 samples:
8.12% Compression
95.85% Recovery.

The formula for % Compression is the difference between the initial thickness minus the compressed thickness divided by the initial thickness. The formula for % Recovery is the recovered thickness divided by the initial thickness. Compression is measured after a 1360 gram steel weight is applied for the period of one minute.

Tensile strength measurements of the gutter fiber show a 60 lb-ft average value for the tensile strength. I believe this is also relevant with the previously transmitted values, so I've sent this along.

Figure 5:
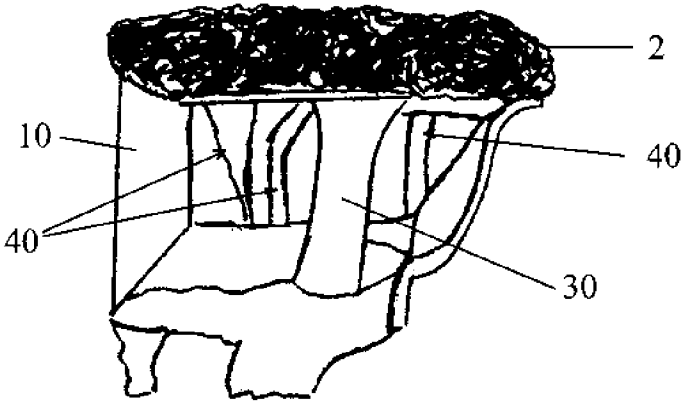
FIG. 5 shows a porous or liquid permeable gutter cover extending along the top of a K-style gutter showing how water flows freely through the porous fiber mat forming the gutter cover, and showing how the gutter cover can extend over a gutter hanger.
Figure 6:
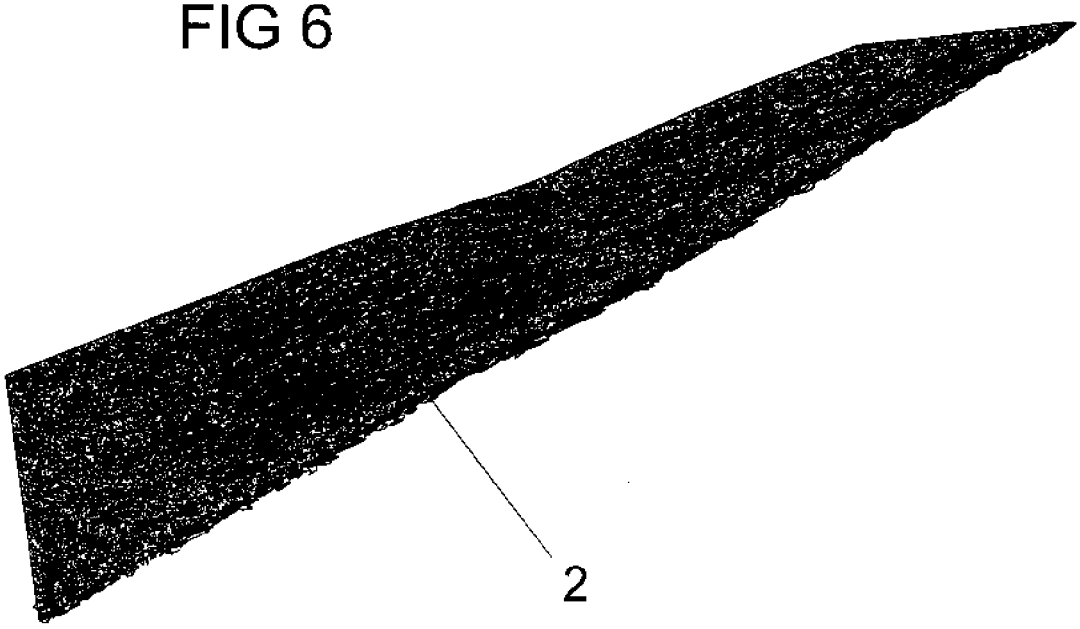
FIG. 6 shows a length of treated nonwoven polyester fibers forming the cover mat and showing the random orientation of the fibers therein. An optional adhesive is shown along the forward facing edge of the cover mat.
Figure 7:
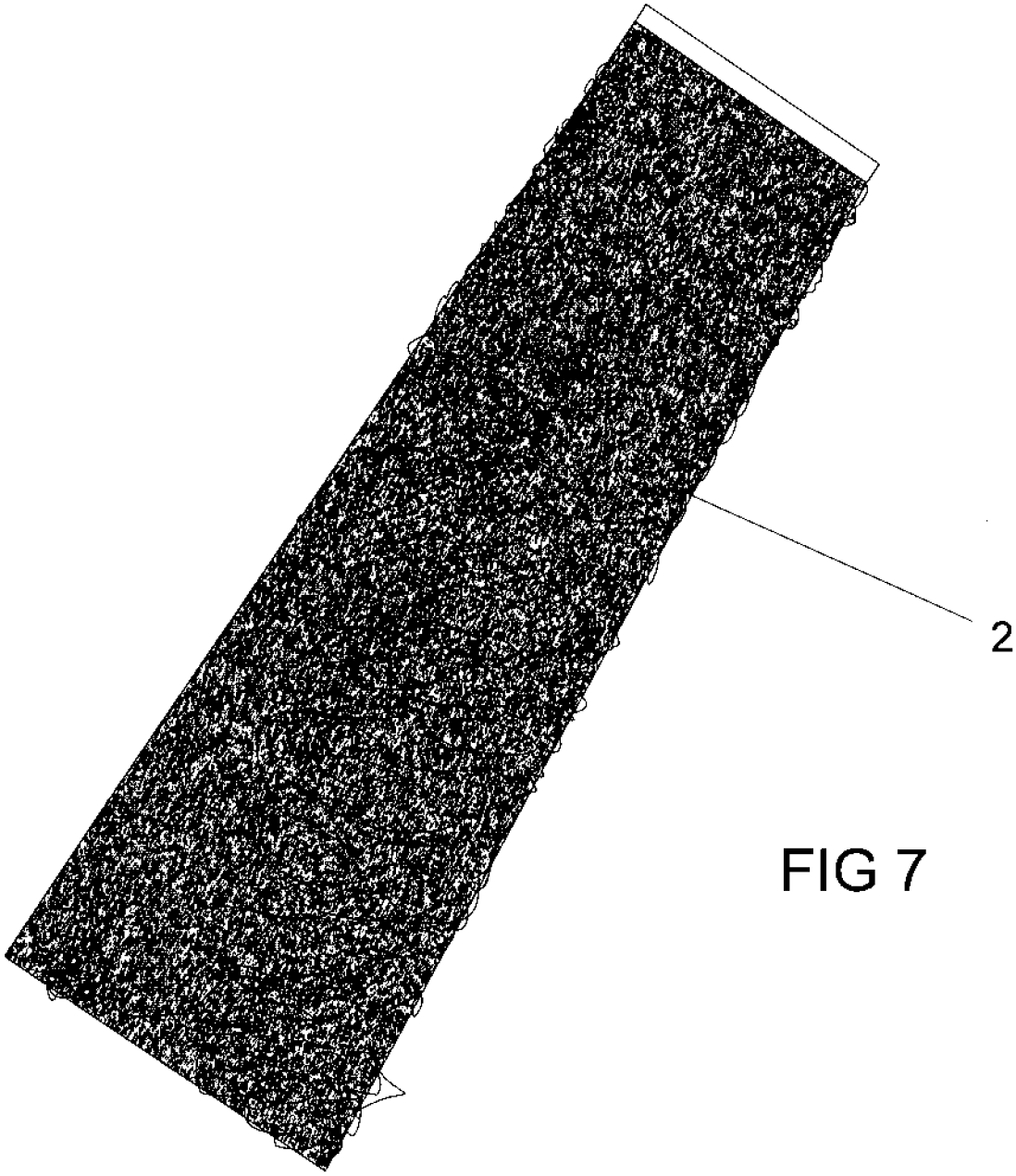
FIG. 7 is another view of the cover mat showing the random orientation of the fibers forming the cover mat. An optional beveled edge is also visible.

The rate of water/air flow through the mat is virtually identical for both a coated and a non-coated material. The coating might affect the rate in a very small way, but it would be almost impossible to differentiate the flow rate of the coated versus the uncoated fiber. The coating has a negligible effect on the flow of either water or air, but does give it the ability to last indefinitely against continued wet/dry cycles, and the coating also gives the fiber the ability to withstand UV degradation over a prolonged period of time. Adding the coating gives us properties that are desirable, and does not impede the flow of air/water. By adding the proper combination of chemicals in a cost effective coating, we have effectively eliminated the need to support the mat inside the gutter without significantly affecting the flow rate through the fiber mat. FIG. 5 shows water 40 flowing through a mat cover 2 alongside a hanger 30 according to this invention.

Although the interference fit between the front edge 4 of the cover mat 2 and the portion of the K-style gutter forming the slot 26 is sufficient to retain the cover mat over the flow channel 18 of the gutter, and adhesive can be added to the rear edge 6 of the cover mat 2. A release liner covering the rear edge 6 can then be removed and the adhesive will engage the inside of the rear gutter wall 12 to further secure the cover mat 2 to the K-style gutter. This adhesive should only be necessary for especially adverse conditions or where the customer wishes for the cover mat to be symmetrically positioned primarily for aesthetic purposes.

In an alternate embodiment, a beveled edge may be formed on the cover mat 2 to facilitate installation in the gutter slot 24 or over hangers or in tight places. The bevel may be cut with a bandsaw or an oscillating blade, and have discussed the future of equipment that would continue to cut the material with either a bandsaw, or perhaps an oscillating blade. Currently, ten (10) inch wide roll of material and cut the angled bevel that yields two five (5) inch pieces in one cut.

The representative embodiments depicted herein are not the only version of this invention that can be employed with standard K-style gutters, or for that matter with other gutter configurations. Therefore the instant invention is not limited to the embodiments discussed herein, but is defined by the following claims as well as to modifications that would be apparent to one of ordinary skill in the art.

We claim:

1. A gutter cover mountable on a rain gutter, the gutter cover comprising:

a porous fiber mat comprising randomly disposed fibers held together by a binding agent;

a nonfibrous coating different from and in addition to the binding agent and separate from the binding agent, and overlying and disposed on and between at least a portion of the fibers within the mat adhering to at least a portion of the fibers and the binding agent holding the fibers together, the coating including a stiffening agent, which coats the randomly disposed fibers forming the porous fiber mat, adding rigidity to the randomly disposed fibers and to the porous fiber mat so that the porous fiber mat can be disposed along the top of the rain gutter and spaced from a lower surface of the rain gutter, without a supporting structure joined to the porous fiber mat, the stiffening agent adding sufficient rigidity to the porous fiber mat so that the porous fiber mat is supportable primarily adjacent opposite edges of the porous fiber mat and not primarily along a lower surface of the porous fiber mat between the opposite edges;

the porous fiber mat remaining sufficiently porous despite the presence of the stiffening agent within the fiber mat to allow passage of rainwater therethrough into the rain gutter, but preventing passage of solid debris into the rain gutter.

2. The gutter cover of claim 1 wherein the coating comprises a styrene material dried after being deposited upon the randomly disposed fibers in liquid form.

3. The gutter cover of claim 2 wherein the binding agent comprises a latex material.

4. The gutter cover of claim 2 wherein the coating includes a PVC material to resist oxidation and UV degradation, and to withstand wet/dry cycles.

5. The gutter cover of claim 4 wherein the coating comprises a flame retardant.

6. The gutter cover of claim 1 wherein the stiffening agent comprises a nonfibrous material.

7. The gutter cover of claim 2 wherein the styrene material comprises a styrene monomer.

8. The gutter cover of claim 1 wherein the porous fiber mat comprises a nonwoven polyester fiber mat having randomly dispersed fiber bonded by the binding agent.

9. The gutter cover of claim 1 wherein the porous fiber mat comprises a compressible, resilient member exhibiting recovery after compression.

10. The gutter cover of claim 1 wherein the coating overlies the binding agent.

11. A rain gutter cover for use with a rain gutter, the rain gutter cover comprising:

a fiber mat further comprising:

a plurality of randomly oriented and nonwoven fibers;

a first material having sufficient tackiness to adhere to the fibers and to bind the fibers together when dried to form the fiber mat so that the fiber mat is sufficiently porous to allow passage of rain water therethrough into the rain gutter when mounted on the rain gutter;

a nonfibrous second material different from and in addition to the first material and disposed at least partially over and coating and disposed between the randomly oriented fibers and within the fiber mat, and adhering to the randomly oriented fibers and the first material binding the fibers together, the second material, when dried, imparting a greater bending resistance to the randomly oriented fibers and to the fiber mat than the first material while the fiber mat remains porous, the second material adding sufficient rigidity to the porous fiber mat so that the porous fiber mat is supportable primarily adjacent opposite edges of the porous fiber mat and not primarily along a lower surface of the porous fiber mat between the opposite edges;

whereby the gutter cover can be disposed on the rain gutter without support other than by portions of the rain gutter to which the fiber mat engages.

12. The gutter cover of claim 11 wherein the fibers comprise polyester fibers and the second material comprises a nonfibrous stiffening agent.

13. The gutter cover of claim 12 wherein the second material comprises a styrene material.

14. An assembly comprising a rain gutter having an inwardly facing slot extending along an outer edge with hangers extending over the rain gutter at spaced locations, the assembly being characterized by:

a rain gutter cover having an front edge insertable into the slot on the rain gutter and lying on the hangers, the gutter cover further comprising;

a fiber mat comprising randomly disposed and nonwoven fibers held together by a binding agent;

a nonfibrous coating, within the fiber mat, different from and in addition to and separate from the binding agent, the coating including a stiffening agent overlying and disposed on and between fibers forming the fiber mat and adhering to the fibers forming the fiber mat and the binding agent holding the fibers together, to coat the randomly disposed fibers and adding rigidity to the randomly disposed fibers and to the porous fiber mat, the coating adding sufficient rigidity to the porous fiber mat so that the porous fiber mat is supported primarily adjacent opposite edges of the porous fiber mat and not primarily along a lower surface of the porous fiber mat between the opposite edges while the fiber mat remains porous so that the porous fiber mat remains elevated in the rain gutter without the use of supporting members attached to or forming part of the porous fiber mat.

15. The assembly of claim 14 wherein an adhesive is disposed between a rear edge of the fiber mat and adjacent to the inner edge of the rain gutter.

16. The assembly of claim 14 wherein the fiber mat has a thickness greater than the height of the slot, the fiber mat being compressible to allow insertion of the fiber mat into the slot.

17. The assembly of claim 14 wherein the fiber mat has a beveled front edge so that the thickness of the fiber mat is greater along the rear edge than along the front edge.

18. The assembly of claim 14 wherein the rain gutter cover comprises a series of fiber mats disposed end to end along the rain gutter.

19. The assembly of claim 14 wherein the stiffening agent comprise a styrene material and the fiber mat is formed of a nonwoven polyester fiber mat with fibers randomly dispersed therein and held together by a latex binding agent.

20. The assembly of claim 14 wherein the stiffening agent comprises a nonfibrous material.

* * * * *